United States Patent [19]

Fite

[11] 4,146,787

[45] Mar. 27, 1979

[54] METHODS AND APPARATUS FOR ENERGY ANALYSIS AND ENERGY FILTERING OF SECONDARY IONS AND ELECTRONS

[75] Inventor: Wade L. Fite, Pittsburgh, Pa.

[73] Assignee: Extranuclear Laboratories, Inc., Pittsburgh, Pa.

[21] Appl. No.: 769,696

[22] Filed: Feb. 17, 1977

[51] Int. Cl.[2] ..... H01J 39/00

[52] U.S. Cl. ..... 250/305; 250/296

[58] Field of Search ..... 250/281, 294, 295, 296, 250/297, 305

[56] References Cited

U.S. PATENT DOCUMENTS

| | | | |
|---|---|---|---|
| 3,710,103 | 1/1973 | Helmer | 250/305 |
| 3,783,280 | 1/1974 | Watson | 250/294 |
| 3,818,228 | 6/1974 | Palmberg | 250/305 |

*Primary Examiner*—Harold A. Dixon

*Attorney, Agent, or Firm*—Penrose Lucas Albright; William B. Mason

[57] ABSTRACT

The selection of charged particles having a narrow band of kinetic energies from emitted charged particles having a wider band of kinetic energies by repulsing those particles having energies less than the lower energy in the transmitted energy band through means of a similarly charged barrier and in the same device insufficiently deflecting the higher energy particles which pass the barrier by a field provided beyond the barrier whereby they fail to pass through an exit aperture. Thus only particles having energies within the desired band pass through an exit aperture which is disposed on the opposite side of the barrier. The pass band of energies is variable in width and location, and the width of the band may be independent or a function of the energy in the band depending on the potentials applied to the barrier and the strength of the field beyond the barrier. When used as an anaylzer for secondary ions which are to be mass analyzed, a thermionic electron source within the analyzer provides a source of ions representative of the residual gas in the vacuum for the purposes of residual gas analysis.

13 Claims, 6 Drawing Figures

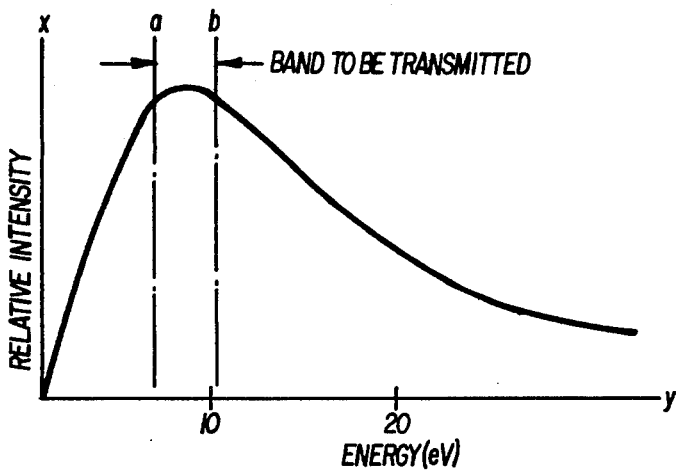
FIG. 1
SECONDARY ION ENERGY DISTRIBUTION
FIG. 2
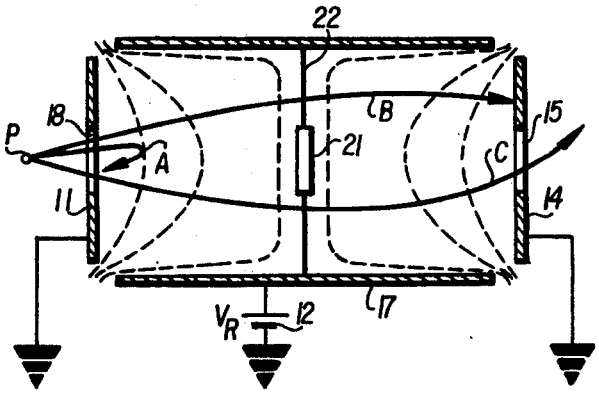
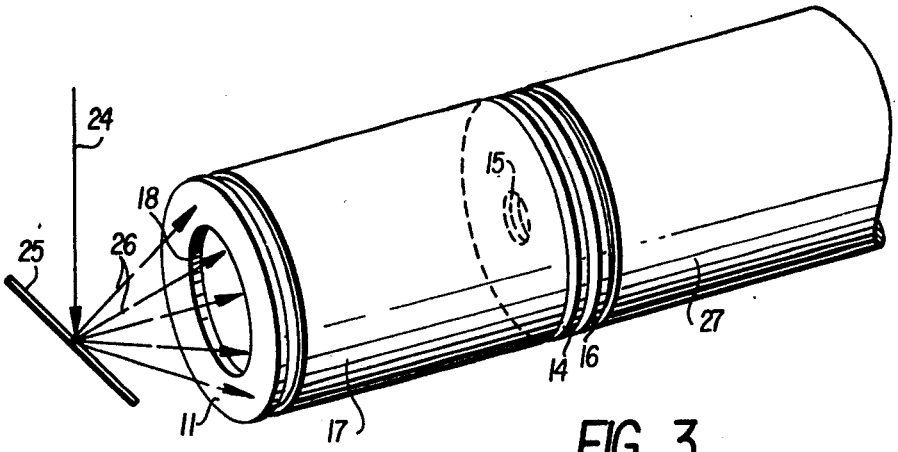
FIG. 3

FIG. 4
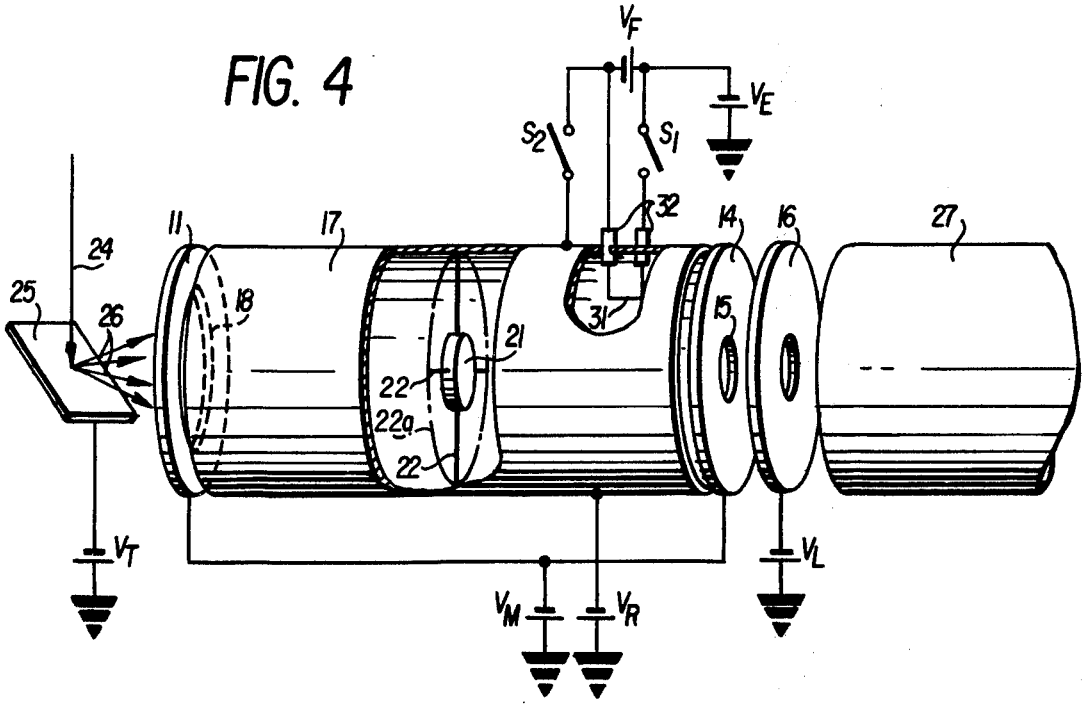
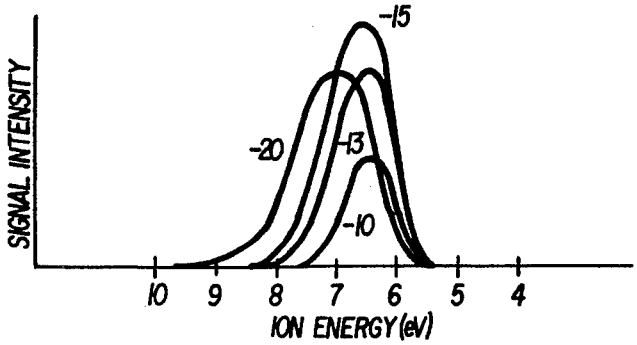
FIG. 5
TRANSMISSION OF POSITIVE IONS FOR VARIOUS POTENTIAL, $V_M$, FOR A FIXED POTENTIAL, $V_R$, OF 5 VOLTS
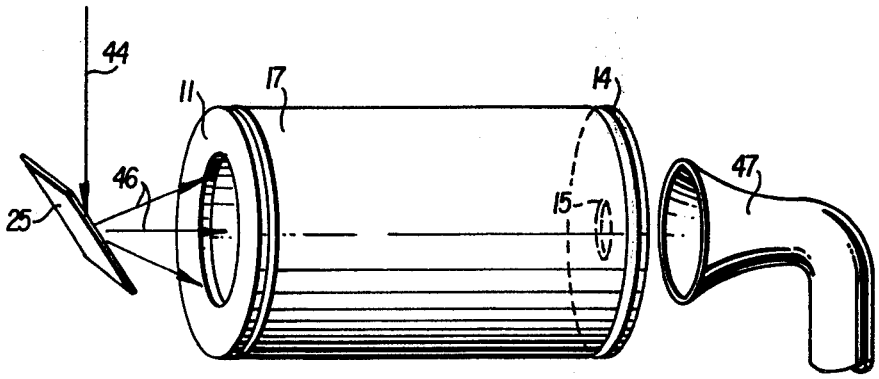
FIG. 6

METHODS AND APPARATUS FOR ENERGY ANALYSIS AND ENERGY FILTERING OF SECONDARY IONS AND ELECTRONS

BACKGROUND OF THE INVENTION

In a number of analytical techinques to determine the chemical constitution of solids, charged secondary particles are observed. In Auger analysis and ESCA (Electron Scattering for Chemical Analysis) the secondary particles are electrons emitted from a surface subjected to a high energy electron beam or an X-Ray beam. The energies of the secondary electrons being characteristic of the chemical elements in the surface. Known analyzers measure these energies.

In Secondary Ion Mass Spectrometry (SIMS), the detected secondary products are either positively or negatively charged ions, the chemical constitution of which is readily determined by passing the ions through a mass-to-charge analyzer or mass spectrometer. However, the secondary ion energy distribution is large, extending to several tens of electron-volts; and mass-to-charge analyzers need a fairly limited range of energies for good mass resolution. To provide same, an energy filter serves the purpose of selecting from the total distribution a limited part of the energy distribution for transmission of same through the mass-to-charge analyzer.

A number of devices are commonly used to accomplish both these tasks. Those known as energy analyzers are designed to transmit a very narrow band of energies; however, when used as energy filters, the band of energies transmitted by the device is enlarged, usually in the interest of increasing the charged particle current which is the signal observed. Such devices are described in many textbooks (See for example, Poul Dahl, "Introduction to Electron and Ion Optics," Academic Press, New York, 1973, Chapter 6.), and include parallel plate analyzers, 127° cylindrical analyzers, 180° spherical analyzers, and cylindrical mirror analyzers, all of which are well known to those skilled in the art of charged particle energy analysis. These devices use electrostatic fields and focus ions of the same energy but initially moving in different directions to the same area or line, while focusing ions of different energies to different areas or lines. Slits or apertures are placed at the location of the area or line to which particles of the desired energy are focused so that these particles emerge from the device while particles of other than the desired energy do not.

A second type of energy analysis system is the Retarding Potential Difference method (RPD) first reported by R. E. Fox, W. M. Hickam, T. Kjeldas and D. J. Grove in the Physical Review, Volume 84, page 859 (1951). In this method the charged particles are induced to travel in a straight line and pass through several apertured plates or planar grids. On one of the plates a sufficient barrier potential is established to repulse particles with less than predetermined energy so that such particles are repulsed, while particles with more than the minimum energy pass through the barrier and effectively are transmitted. The distribution of energies is obtained or the energy analysis is performed by slightly changing the barrier potential and observing the change of transmitted charged particle current resulting therefrom. Particles are not deflected in the RPD method (except for those which are deflected through 180° in being repulsed or mirrored backward) and the RPD analyzer is thus basically a low energy cut-off device.

Recently another class of energy analyzers have been introduced which are known under the general name of "Bessel Boxes", a name deriving from the mathematical solution of the potentials within these analyzers wherein it is necessary to use a series of Bessel Functions.

In these analyzers charged particles are admitted through an aperture (or annulus) in a conducting entrance plate, the plane of which is perpendicular to the axis of and adjacent to one end of a hollow conducting main cylinder. A conducting exit plate containing an aperture (or annulus) is situated at the opposite end of the cylinder so that the exit plate is parallel to the entrance plate. Potentials are placed on the entrance and exit plates and on the main cylinder whereby charged particles are retarded after entering the device in a manner reminiscent of the RPD method. And, as in the RPD method, if a particle does not have a minimum energy as determined by the potentials, it will be repulsed back toward the entrance aperture. However, here the analogy ends. Particles in a Bessel Box are not restricted to straight line movement along the axis of the device; the structure is such that they cannot move along the axis of the device. Where annuli are used in the end plates, particles enter the box off its axis; where apertures are provided at the ends to admit on the entrance end the particles moving in the direction of the axis, a solid stop, disposed in the center of the main cylinder, intercepts any particles which may be moving along the axis. It is thus necessary, one way or another, for a particle to be deflected if it passes through a Bessel box. A particle with energy which is slightly more than the minimum requisite energy moves relatively slowly through the main cylinder and is substantially deflected by the weak electric fields therein into the exit aperture. However, particles having energy which is substantially higher than the minimum are deflected insufficiently by the weak fields to arrive at the exit aperture. Thus a Bessel Box possesses a high-energy as well as a low-energy cut-off, unlike the RPD devices which possess only the low energy cut-off.

A Bessel Box is described by J. D. Allen, Jr., J. D. Durham, G. K. Schweitzer and W. E. Deeds in the *Journal of Electron Spectroscopy and Related Phenomena*, Volume 8, pages 395–210, (1976) provides annuli at both the exit and entrance apertures without utilizing electrodes or other elements within the Bessel Box, as such. This instrument was found to give very good energy resolution and has been employed as an energy analyzer. Another Bessel Box of which the inventor has knowledge, used as an analyzer with good energy resolution, is one which insofar as known has not yet been described in scientific or patent literature, but has been recently used by Mr. Peter Erdman and Professor Edward C. Zipf of the Department of Physics at the University of Pittsburgh. It has small circular apertures placed exactly in the center of both the entrance and exit plates. Particles are prevented by going on a straight line path between apertures by affixing within the box a circular metallic stop, having a diameter slightly larger than the diameter of the apertures, exactly in the center of the device.

Both Bessel Boxes of Allen and his associates and of Erdman and Zipf, which are used as energy analyzers, require very narrow annuli or small apertures. Although they achieve good energy resolution, the signals of transmitted currents are small.

The inventor has found that by substantially increasing the aperture diameters and annuli gaps, the acceptance apertures of Bessel Boxes are increased and sufficient energy resolution is maintained to permit their use as efficient energy *filters*, apposite energy *analyzers*. In fact these modified Bessel Boxes actually perform more satisfactorily than the conventional energy filters particularly with regard to: () the efficienty of the acceptance of the aperture, and (b) the independence of establishing an energy pass band width from the mean energy of particles transmitted. Moreover, these modified Bessel Boxes are particularly useful as energy filters in combination with quadrupole mass spectrometers as detectors in secondary ion mass spectrometry.

SUMMARY OF THE INVENTION

This invention relates to a system for selecting a group of charged particles having a limited range of energies in a band-width of two or three electron volts (ev) from a larger group of charged particles having a larger range of energies.

More particularly, the invention is directed to a system of receiving charged particles within a charged tube wherein the particles which enter the tube entrance are retarded and then re-accelerated for exiting through a further opening in the tube, the geometry of the tube and apertures (and further apparatus as may be included within the tube) being such that a particle traveling in a straight line cannot pass from its entrance to its outlet due to the location of same or stop means disposed within the tube. Such tube is provided with a relatively large entry opening or aperture so as to receive a substantial portion of the charged particles. Particles which have passed through the tube are guided by focusing fields or the like into a mass analysis device such as a quadrupole mass filter. By repulsing charged particles of weak energies and failing to deflect and pass through the tube charged particles having high energies, a selected energy band of the particles is established which passes through the tube. The tube may also be combined with an electron emission means whereby the residual gas within the tube may be ionized. Typically, the entrance to the tube is substantially larger in area than the outlet opening. The tube is confined in space which is maintained for operation at $10^{-4}$ Torr or better and is composed of metal — specifically stainless steel. It has been found that the invention not only effectively filters particles for mass analysis or other purposes, but additionally, it provides signals which are greater by a magnitude of at least ten than occurs with conventional energy filters such as a cylindrical mirror analyzer.

The adaptabilities and capabilities of the invention will be more completely understood from the following description, reference being had to the accompanying drawings, in which:

BRIEF DESCRIPTION OF THE DRAWINGS

FIG. 1 illustrates a primary object of the invention as applied to Secondary Ion Mass Spectrometry wherein the distribution of secondary ions are illustrated in a graph together with a selected energy band for filtration and transmission into the mass spectrometer;

FIG. 2 is a schematic illustration of one configuration of the invention which shows the electric fields within the device;

FIG. 3 illustrates the invention in a perspective view as affixed to the entrance of a quadrupole mass filter;

FIG. 4 is a further perspective view of the energy filter which includes the basic electric circuit and includes an auxiliary electron emitting filament;

FIG. 5 is a graph of data, taken with an operating device of the type disclosed, which illustrates the variability of the transmitted energy band width which may be obtained with different potentials applied to the entrance and exit plates; and FIG. 6 is a perspective view of the invention utilized as energy analyzer for Auger electrons.

DESCRIPTION OF THE PREFERRED EMBODIMENTS

Referring to the figures, FIG. 1 demonstrates the purpose of the invention as applied to secondary ion mass spectrometry, wherein secondary ions are formed with energies covering a range of several tens of ev, and the selection of a smaller range of energies (having a band width of 2 to 3 ev) is desired which are more numerous in the entire distribution. The vertical axis x indicates the relative intensity or amount of secondary ions produced and the horizontal axis y indicates the relative energy distribution of such ions. The vertical lines a and b designate between them the band of ions having the desired energies. As will be described, only those ions falling within the a–b energy band width are transmitted and the positions of the limits established by lines a and b are adjustable.

The operation of the device may be understood with reference to FIG. 2. Here, as in all embodiments, the structure is confined in a vacuum of $10^{-4}$ torr or better. Charged particles from a point source P enter through an aperture 18 in a stainless steel entrance plate 11 which is electrically grounded. A stainless steel tube or cylinder 17 is provided a potential $V_R$ from a voltage source 12 which has the effect of retarding all charged particles entering cylinder 17 from point P. Centered in cylinder 17 is a metal stop 21 which functions as a charged barrier to prevent any particles from transversing in a straight line along the center and emerging through the aperture 15 in an exit plate 14, said stop 21 being supported on a mesh or grid wire structure 22. The dashed lines in the figure represent equipotential surfaces. A charged particle from the point source P with less than a minimum energy follows a trajectory, as illustrated by trajectory A, wherein the particle is retarded, repulsed and then repelled back toward the entrance aperture. In contrast, a particle with excessive energy follows a trajectory B. Because the electric fields near the center of the device are very weak, they do not appreciably deflect a particle with energy which is at least somewhat in excess of the minimum selected energy. A particle with energy in the desired narrow range of energies, with the lowest energy being the minimum energy, follows a trajectory C and is thus deflected into and through the exit aperture in the exit plate 16.

FIG. 3 illustrates the invention affixed to the ion entrance of a quadrupole mass filter in the secondary ion mass spectrometer application. A beam of high energy primary ions 24 strikes a solid target 25 and secondary ions 26 are emitted. Some of the ions 26 enter an aperture 18, in the entrance plate 11. After emerging through an aperture 15 in the exit plate 14, ions 26 are focused by means of a lens 16 into a mass filter 27. Conventional structure for mounting the various elements of the invention are well within the state of the art and their illustration would serve no useful purpose.

FIG. 4 illustrates in additional detail the energy filter with the basic electrical circuits and connections. It also shows an auxilliary electron-emitting filament which serves purposes to be described. This drawing repeats the basic features discussed previously utilizing the same reference numerals, and provides details of the mounting for stop 21 on a set of crossed wires 22 (or optionally this may be accomplished by other appropriate means such as transparent metal mesh 22a located midway along the length of the device). The crossed wire structure 22 (or mesh 22a) is electrically connected to cylinder 17 and metal stop 21, is therefore maintained at the same potential as cylinder 17. Cylinder 17 also contains a filament 31 mounted on two insulated feedthroughs 32. A current produced by the voltage supply (shown here by the battery symbol) $V_F$ passes through filament 31 whereby it may be heated to a sufficient temperature for the effective thermionic emission of electrons. When used as an energy filter for secondary ions in a SIMS application a switch, $S_1$, is open so that the filament is turned off, and the switch $S_2$ is closed whereby the potential of the filament 31 is maintained the same as that of cylinder 17.

The material target 25 may be electrically biased by the potential source $V_T$, to adjust the absolute kinetic energies of the secondary ions 26 either towards higher or lower values as they approach entrance plate 11. Entrance plate 11, which is electrically connected to the exit plate 14, may also be electrically biased, as desired, by the potential source $V_M$, which has the effect of further adjusting kinetic energies of the secondary ions. These adjustments of kinetic energies are desirable for the selection of the transmitted band of kinetic energies to contain or to be near the peak of the initial kinetic energy distribution as illustrated by band width a–b in FIG. 1 while maintaining their velocity in a range whereby the quadrupole mass filter 27 operates efficiently and with good mass resolution. Cylinder 17 is biased by means of a potential source $V_R$ which is selected to retard ions that pass through the aperture 18 in the entrance plate 11. Lens 16 is biased by means of a potential source $V_L$ which focuses ions emerging through the exit aperture 15 into quadrupole mass filter 27. Although shown as a single lens 16 in this figure, more than one lens element, either of a planar or cylindrical or other configuration, may be used for improved focusing of the ions received into the quadrupole mass filter 27.

When the energy filter is about 7.5 cm in length with an internal diameter of the main cylinder of about 2.5 cm, and with an entrance aperture diameter of 1 cm, a stop diameter of 0.8 cm and an exit aperture diameter of 0.6 cm, typical potentials for selection of positive ions with a band of energies centered at 6.5 and a 2.5 ev total band width are as follows:

$$V_M = -10 \text{ volts}, V_R = 5 \text{ volts}.$$

Data from an operating device of the type disclosed is depicted in FIG. 5 which illustrates the selectivity of different transmission energy band-widths by varying potential $V_M$ on the entrance and exit plates, when the main cylinder $V_R$ is 5 volts. Variations of $V_M$ at $-10$, $-13$, $-15$ and $-20$ volts are shown. By maintaining the difference between $V_R$ and $V_M$ constant while varying both, the most probable energy of the transmitted band is moved but the width of the band remains essentially constant. By holding $V_M$ fixed and varying $V_R$, the most probable energy of the transmitted band is varied and the width of the transmitted band also changes approximately proportional to the varying value of $V_R - V_M$.

In using the device of FIG. 4 to determine the mass spectrum of residual gases in the vacuum chamber housing the invention, $V_M$ is set to 0 volts and $V_R$ is typically set to $+5$ volts. Switch $S_2$ is opened and the switch $S_1$ is closed. The potential source $V_E$ then determines the energy of the ionizing electrons, and is typically set within a range of $-70$ to $-100$ volts. Ions formed by electron impact ionization of residual gas in the vicinity of the exit plate 14 are, as a result, drawn into the quadrupole mass filter for mass and abundance analysis.

It is to be understood that the energy filter disclosed may be employed in conjunction with mass-to-charge analyzers, other than quadrupole mass filters, as known to those skilled in the art. It is also to be understood that variations in the particular geometry of the device fall within the scope of the invention.

A principal virtue of the invention is that by making the entrance aperture 18 large, it provides a much larger solid angle through which charged particles may be received than conventional energy filters such as the cylindrical mirror analyzer. Consequently, for secondary ion mass spectrometry and in other applications such as Auger electron spectroscopy, the finally detected signals are substantially larger and the devices described herein provide much more sensitive detection of low level energy-analyzed signals. In the course of trials with the present invention, direct comparison was made with a conventional cylindrical mirror analyzer of similar over-all size and comparable energy band width. It was found that the analyzed signals from the same ion source were twenty-five times larger with the invention than with the cylindrical mirror device.

FIG. 6 shows the invention used as an energy analyzer for Auger electrons. The primary high-energy electron beam 44 strikes the target surface 25 and emits secondary electrons 46. These electrons pass through the device in the same manner as the ions discussed previously and, after emergence from the exit aperture 15, strike an electron detector 47, depicted here as a well-known channeltron device, although any other sensitive electron detector could equally well be utilized. It is clear to those skilled in the art that for analysis of electrons or negative ions, all the potentials disclosed relative to the invention are reversed in sign from those used for energy selection of positive ions.

Although the preferred embodiments of the invention have been described, it is to be understood that the invention is capable of other adaptations and modifications, such as modified geometry and dimensions, which will be understood by those skilled in the art. For example, the mass-to-charge analyzer 27 may be a quadrupole mass filter, a magnetic mass spectrometer or the like. Detectors provided to measure the charge of particles received from such analyzers may be electron multipliers, a Faraday cup or the like. The means for producing high-energy primary charged particles 24 or 44 may be a scanning device such as an electron scanning device. Thus elements or steps as set forth in the claims should not be construed only to cover the corresponding structure and acts described in the specification but also the equivalents thereof.

Having thus described my invention, what I claim as new and desire to secure by Letters Patent of the United States is:

1. Apparatus for the selection of charged particles having a relatively narrow band width of kinetic energies from a group of charged particles from a source therefor having a distribution in excess of said selected band width, the apparatus comprising: a tube and a pair of end plates therefor, said tube and said plates being composed of material which retains an electrostatic potential applied thereto and is sufficiently conductive to dissipate the charges of charged particles which impinge thereon in operation of the apparatus, said tube and said end plates defining a confined space; an entrance opening defined at least in part by one of said end plates, an exit opening defined at least in part by the other said end plate, said entrance opening being substantially larger than said exit opening and having a relatively large solid angle relative to said particle source; impenetrable means disposed in said space whereby charged particles are prevented from passing through said space without experiencing deflection or repulsion from said entrance opening to said exit opening, and electrical circuit means for establishing selected electrostatic potentials on said tube, end plates and impenetrable means, said electrostatic potential on said tube and impenetrable means being the same and greater than said electrostatic potentials on said end plates, said impenetrable means being composed of material which retains an electrostatic potential applied thereto and also being sufficiently conductive to dissipate charged particles which impinge thereon during operation of the apparatus, said circuit means including means whereby the electrostatic potential placed on said end plates may be differentiated by a selected amount of potential from the electrostatic charge on said tube and said impenetrable means.

2. Apparatus in accordance with claim 1, wherein said tube is cylindrical and wherein said entrance opening and said exit opening have axes coincident with the longitudinal axis of the tube, said impenetrable means comprising a solid metal stop suspended in said tube at a point between said openings.

3. Apparatus in accordance with claim 2, wherein said charged particles are electrons, in combination with a detector for electrons which is located to receive same from said exit opening.

4. Apparatus in accordance with claim 3, wherein said detector is an electron multiplier.

5. Apparatus for the selection of charged particles having a relatively narrow band width of kinetic energies from a group of charged particles having a distribution in excess of said selected band width, the apparatus comprising: a tube and a pair of end plates therefor composed of material which retains an electrical charge applied thereto and is sufficiently conductive to dissipate the charges of charged particles which impinge thereon in operation of the apparatus, said tube and said end plates defining a confined space; an entrance opening defined at least in part by one of said end plates, an exit opening defined at least in part by the other said end plate, said entrance opening being substantially larger than said exit opening; impenetrable means disposed in said space whereby charged particles are prevented from passing through said space without experiencing deflection or repulsion from said entrance opening to said exit opening; electrical circuit means for establishing a selected electrical charge on said tube, end plates and impenetrable means; an electron emitting filament mounted in said tube whereby electron impact ionization of residual gases in said space may be produced; a mass spectrometer being provided to receive charged particles which pass from said space through said exit opening.

6. Apparatus for the selection of charged particles having a relatively narrow band width of kinetic energies from a group of charged particles having a distribution in excess of said selected band width, the apparatus comprising: a tube and a pair of end plates therefor composed of material which retains an electrical charge applied thereto and is sufficiently conductive to dissipate the charges of charged particles which impinge thereon in operation of the apparatus, said tube and said end plates defining a confined space; an entrance opening defined at least in part by one of said end plates, an exit opening defined at least in part by the other of said end plates, said entrance opening being substantially larger than said exit opening; impenetrable means disposed in said space whereby charged particles are prevented from passing through said space without experiencing deflection or repulsion from said entrance opening to said exit opening, an electrical circuit means for establishing a selected electrical charge on said tube, end plates and impenetrable means, a mass-to-charge analyzer being provided to receive charged particles which pass through said exit opening and wherein said particles passing through said mass-to-charge analyzer are received by a detector adapted to measure the charge of the particles received therefrom.

7. Apparatus in accordance with claim 6, wherein said detector is an electron multiplier.

8. Apparatus in accordance with claim 6, wherein said detector is a Faraday cup.

9. Apparatus in accordance with claim 6, wherein said mass-to-charge analyzer is a quadrupole mass filter.

10. Apparatus in accordance with claim 6, wherein said mass-to-charge analyzer is a magnetic mass spectrometer.

11. Apparatus in accordance with claim 6, wherein material to be analyzed is placed near said entrance opening, means being provided to form secondary ions from said material by impact of the surface thereof by high-energy ions.

12. Apparatus in accordance with claim 6, wherein a material to be analyzed is disposed proximate said entrance opening and means is provided to form secondary ions by impact on the surface of said material by high-energy electrons.

13. Apparatus in accordance with claim 12, wherein said means for producing said high-energy electrons comprises an electron scanning device.

* * * * *